US009025805B2

(12) United States Patent
Akino

(10) Patent No.: US 9,025,805 B2
(45) Date of Patent: May 5, 2015

(54) CONDENSER MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/221,795

(22) Filed: Mar. 21, 2014

(65) Prior Publication Data

US 2014/0355808 A1 Dec. 4, 2014

(30) Foreign Application Priority Data

May 31, 2013 (JP) ..... 2013-114917

(51) Int. Cl.

| | |
|---|---|
| ***H04R 1/20*** | (2006.01) |
| ***H04R 3/00*** | (2006.01) |
| ***H04R 9/08*** | (2006.01) |
| ***H04R 1/04*** | (2006.01) |

(52) U.S. Cl.

CPC ..... *H04R 1/04* (2013.01)

(58) Field of Classification Search

CPC ..... H04R 1/04; H04R 1/20; H04R 1/38; H04R 19/04

USPC ..... 381/113, 355, 356, 358–362, 369, 170, 381/174, 177

See application file for complete search history.

(56) References Cited

U.S. PATENT DOCUMENTS

| | | | | |
|---|---|---|---|---|
| 2006/0045302 | A1* | 3/2006 | Akino et al. | 381/355 |
| 2006/0251274 | A1* | 11/2006 | Akino | 381/111 |
| 2012/0063629 | A1* | 3/2012 | Akino | 381/355 |
| 2012/0263332 | A1* | 10/2012 | Akino | 381/355 |

FOREIGN PATENT DOCUMENTS

| | | |
|---|---|---|
| JP | 2011-009807 | 1/2011 |
| JP | 2014-011703 | 1/2014 |

* cited by examiner

*Primary Examiner* — Tuan D Nguyen

(74) *Attorney, Agent, or Firm* — Whitham Curtis Christofferson & Cook, PC

(57) ABSTRACT

A condenser microphone includes a unit case that supports a condenser microphone unit, has an internal space in communication with a rear acoustic terminal of the microphone unit, and has an opening in a peripheral wall in communication with the internal space; a volume restrictor that reduces the volume of the internal space by partitioning the internal space; a circuit board disposed in the internal space and surrounded by the volume restrictor; and a rigid conductor that electrically connects a signal output terminal of the microphone unit and the circuit board. The circuit board intersects the center axis of the unit case. The rigid conductor is supported such that the rigid conductor slides along the volume restrictor. An elastic conductor is compressed between the rigid conductor and the circuit board or between the rigid conductor and the signal output terminal of the microphone unit.

12 Claims, 2 Drawing Sheets

CONDENSER MICROPHONE

BACKGROUND OF THE INVENTION

1. Technical Field

The present invention relates to a condenser microphone that does not undergo the vibration of an electronic circuit under high acoustic pressure to have an excellent frequency response and generate noiseless high-quality audio signals.

2. Background Art

Microphones are placed near musical instruments for collection of the musical sound generated from the instruments under enormously high acoustic pressure. Condenser microphones are often used near musical instruments because they are usually smaller than dynamic microphones and thus do not interfere with the action and view of the players of the musical instruments. A condenser microphone used to collect the musical sound in a theater is often used for amplification (which sometimes is also referred to as "public address (PA)") and most of them have unidirectionality. A unidirectional condenser microphone has an opening on the side of the microphone case that is in communication with a rear acoustic terminal of the condenser microphone unit. The opening allows acoustic waves to reach the rear acoustic terminal of the condenser microphone unit.

A condenser microphone requires an electronic circuit, such as an impedance converter, to reduce the output impedance of the microphone unit. This structure differs from dynamic microphones that output signals from both ends of a voice coil disposed in a magnetic field. Although a condenser microphone inevitably includes an electronic circuit, it should be compact as much as possible. Thus, the circuit board on which the electronic components are mounted is installed near the rear acoustic terminal of the microphone unit.

The use of such a condenser microphone near a musical instrument causes acoustic waves with high acoustic pressure to enter the microphone case and vibrate the circuit board. The vibration of the circuit board causes the vibration of the electronic components mounted on the circuit board. This generates extra sounds (noise) other than the target sound to be acousto-electrically converted by the microphone unit. If a film capacitor is mounted on the circuit board, the vibration varies the distance between the films of the film capacitor and causes a fluctuation in the capacitance. The fluctuation in the capacitance causes noise. The vibration of the circuit board also causes the fluctuation in the capacitance and thus noise. Such noise impairs sound quality. Thus, it is desirable to prevent the vibration of the electronic components caused by acoustic waves.

A microphone unit case (hereinafter referred to as "unit case") has a space in communication with an opening behind the rear acoustic terminal of the microphone unit. The circuit board on which the electronic components are mounted is accommodated in this space. The space functions as an acoustic capacitor. Thus, the acoustic mass of the space resonates with the opening of the unit case. Such resonance impairs the frequency response of the microphone. A large space can readily accommodate the circuit board on which the electronic components are mounted but has reduced impedance of the acoustic mass. Thus, the large space readily causes resonance in the main frequency range for sound pickup.

An increase in the impedance of the acoustic mass requires a decrease in the space. A reduced volume of the space increases the impedance of the acoustic mass and the resonant frequency of the space. A resonant frequency of the space higher than the upper limit of the main frequency range of sound pickup does not impair the directional frequency response in frequency ranges below the resonant frequency.

A known condenser microphone has a filler functioning as an acoustic resistor disposed in the space in the microphone case disposed behind the rear acoustic terminal of the condenser microphone unit (refer to Japanese Patent Application Publication No. 2011-9807). An object of the known condenser microphone is to prevent resonance of the space. The filler used in the condenser microphone according to Japanese Patent Application Publication No. 2011-9807 is sintered plastic having continuous pores. The filler is disposed in the space in the microphone case. The filler functions as an acoustic resistor against the sound waves entering the space through the opening on the side of the microphone case to prevent the resonance of the space.

The condenser microphone according to Japanese Patent Application Publication No. 2011-9807 prevents the resonance of the internal space of the microphone case. Unfortunately, the condenser microphone according to Japanese Patent Application Publication No. 2011-9807 does not accommodate an electronic circuit in a small space in a microphone case and does not have a structure to prevent the vibration of the electronic circuit due to sound waves entering the microphone case.

The inventor filed a patent application for a condenser microphone (refer to Japanese Patent Application No. 2012-148150 (U.S. counterpart to the Japanese Application is U.S. Patent Application Publication U.S. 2014/0003628) that includes: a condenser microphone unit; a microphone case that accommodates the condenser microphone unit, a space connecting to a rear acoustic terminal of the condenser microphone unit, and an opening in a peripheral wall connecting to the space; a volume restrictor that is disposed in the internal space of the microphone case and reduces the volume of the internal space; and an electronic circuit disposed in the internal space of the microphone case and surrounded by the volume restrictor, wherein the volume restrictor also serves as a shield that prevents sound waves entering the internal space through the opening in the microphone case from reaching the electronic circuit.

The condenser microphone according to the copending patent application has a small space in the microphone case in communication with the rear acoustic terminal and microphone case of the microphone unit. The small space barely resonates, and thus contributes to an excellent frequency response. The volume restrictor blocks acoustic waves with high acoustic pressure entering the microphone case not to reach the electronic circuit. Thus, noise is not generated by the vibration of the electronic components.

SUMMARY OF THE INVENTION

In a condenser microphone according to Japanese Patent Application No. 2012-148150 and illustrated in the accompanying drawings, the electronic components are mounted on a circuit board, and a first end of the circuit board protrudes outward from a volume restrictor. The first end of the circuit board is electrically connected to a signal output terminal of the microphone unit via a conductive support. Thus, part of the circuit board must protrude outward from the volume restrictor, and this limits the design flexibility.

An object of the present invention, which has been conceived through the improvement of the Japanese Patent Application No. 2012-148150, is to provide a condenser microphone that has excellent design flexibility on a circuit board on which electronic components are mounted.

A condenser microphone according to the present invention comprises: a condenser microphone unit having a rear acoustic terminal; a unit case that supports the condenser microphone unit, has an internal space in communication with the rear acoustic terminal of the condenser microphone unit, and has an opening in a peripheral wall in communication with the internal space; a volume restrictor that is disposed in the internal space of the unit case and reduces the volume of the internal space by partitioning the internal space; a circuit board that is disposed in the internal space partitioned by the volume restrictor of the unit case and surrounded by the volume restrictor; and a rigid conductor that electrically connects a signal output terminal of the condenser microphone unit and the circuit board, wherein, the circuit board is disposed such that a surface of the circuit board intersects the center axis of the unit case, the rigid conductor is supported in such a manner that the rigid conductor slides along the volume restrictor, and an elastic conductor is compressed between the rigid conductor and the circuit board or between the rigid conductor and the signal output terminal of the condenser microphone unit.

The volume restrictor reduces the volume of the internal space of the unit case. The small space barely resonates, and thus contributes to an excellent frequency response. The volume restrictor blocks acoustic waves with high acoustic pressure entering the unit case such that the acoustic pressure does not to reach the circuit board. Thus, noise is not generated by the vibration of the electronic components. The slidable rigid conductor electrically connects the microphone unit and the circuit board. Thus, the circuit board does not require a special structure for the electrical connection with the rigid conductor and has increased design flexibility.

DESCRIPTION OF THE PREFERRED EMBODIMENT

A condenser microphone according to an embodiment of the present invention will now be described with reference to FIGS. 1 and 2.

Embodiment

Figure 1:
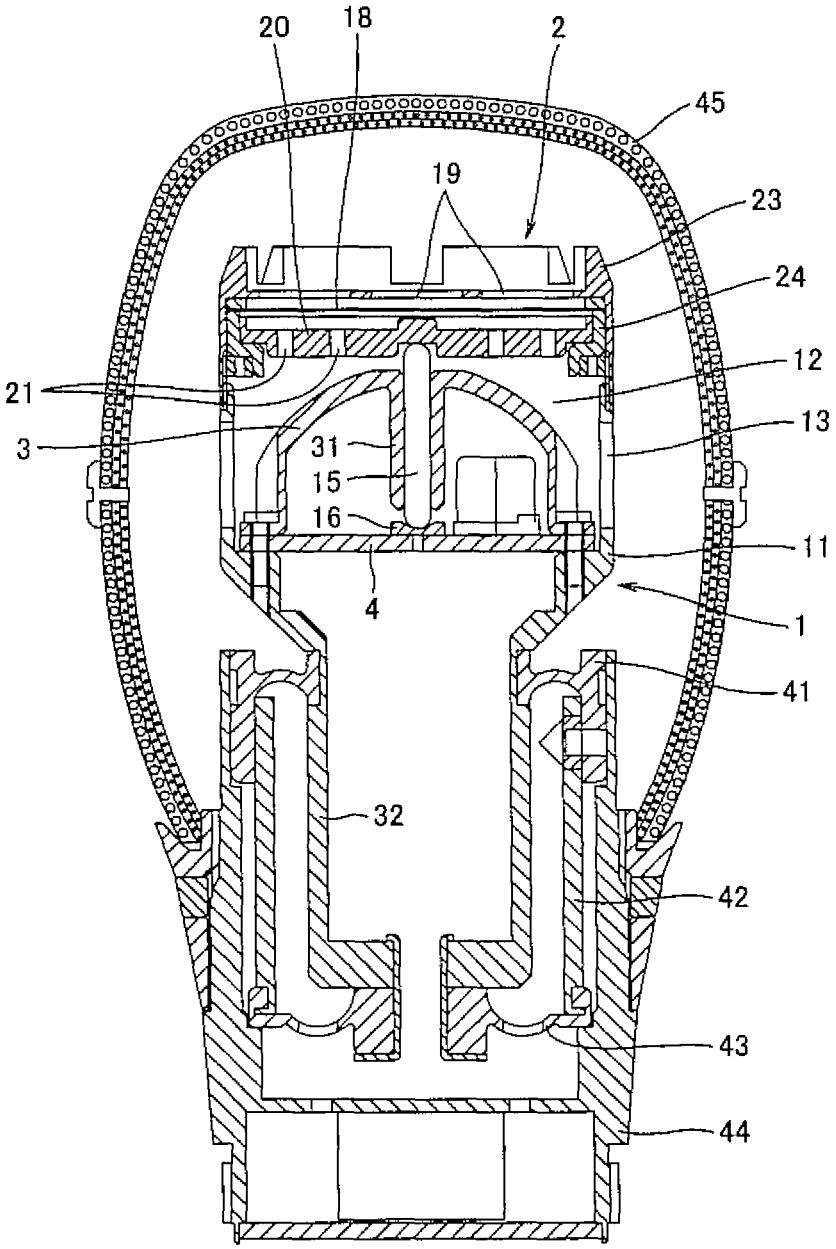
FIG. 1 is a longitudinal cross-sectional view of a condenser microphone according to an embodiment of the present invention.
Figure 2:
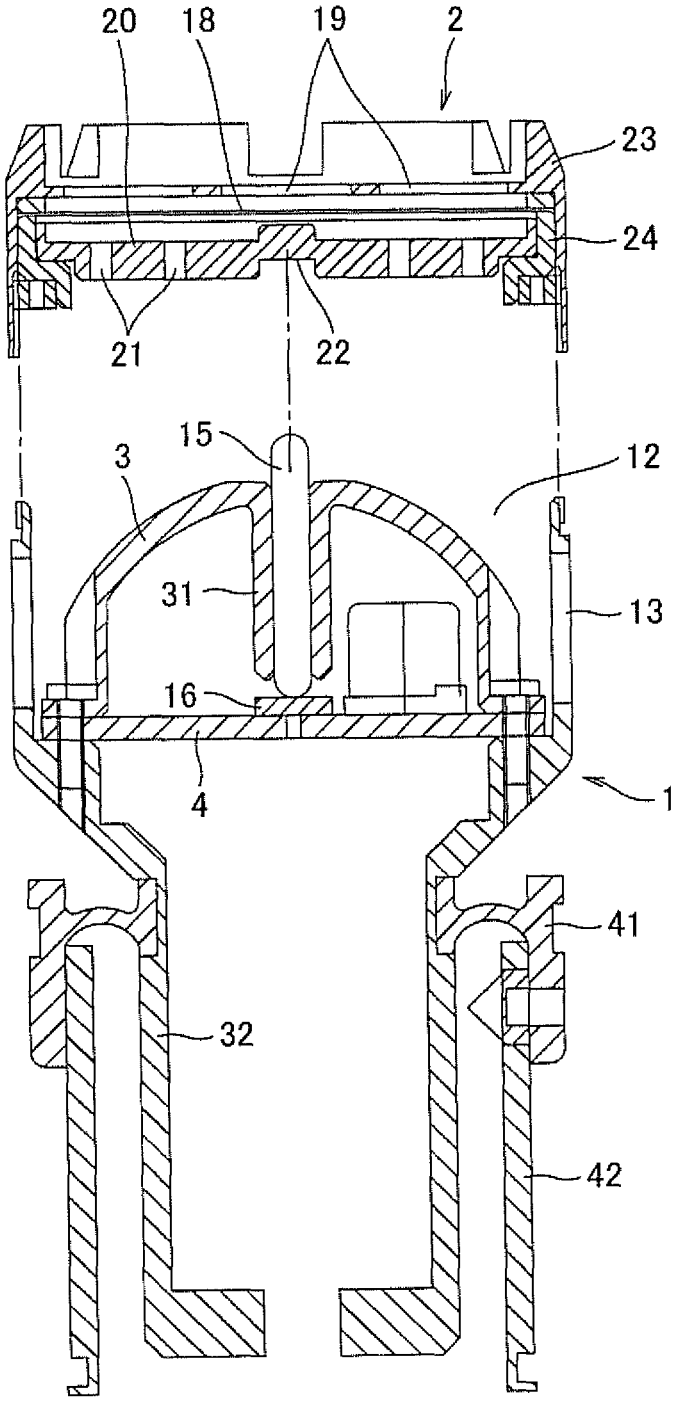
FIG. 2 is an exploded longitudinal cross-sectional view of essential parts of the condenser microphone.

FIGS. 1 and 2 illustrate a microphone unit case 1. The unit case 1 includes a substantially cylindrical main body 11 and a head case 23 that covers an opening at the end of the main body 11. The main body 11 has an internal space 12. The head case 23 accommodates a condenser microphone unit 2. The condenser microphone unit 2 includes a diaphragm 18 that vibrates in response to entering sound waves; a fixed electrode 20 that faces the diaphragm 18 at a predetermined gap; and an insulating support 24 that supports the diaphragm 18 and the fixed electrode 20 inside the head case 23. The peripheral wall of the main body 11 has a predetermined number of openings 13. The internal space 12 of the main body 11 is in communication with the openings 13, which are in communication with the exterior of the microphone. The condenser microphone unit 2 has unidirectionality.

The diaphragm 18 and the fixed electrode 20 define a capacitor. Sound waves are acousto-electrically converted as the vibration of the diaphragm 18 varies the capacitance of the capacitor. The head case 23 has an opening 19 through which sound waves enter the condenser microphone unit 2. The opening 19 serves as a front acoustic terminal. The fixed electrode 20 has a predetermined number of holes penetrating the fixed electrode 20 across the thickness direction and communicating the space behind the diaphragm 18 with the exterior of the condenser microphone unit 2. These holes serve as a rear acoustic terminal 21. The internal space 12 of the main body 11 is in communication with the rear acoustic terminal 21 and the openings 13, as described above.

A circuit board 4 is fixed inside the main body 11. The circuit board 4 is disposed such that the substrate surface intersects the center axis of the main body 11. The substrate surface of the circuit board 4 is a surface on which electronic components are mounted. The circuit board 4 is disposed such that the surface on which electronic components are mounted is orthogonal to the center axis of the main body 11.

The circuit board 4 separates the interior of the main body 11 into an upper compartment and a lower compartment, as illustrated in FIGS. 1 and 2. The interior of the upper compartment in the main body 11 is the space 12. A hemispherical volume restrictor 3 protrudes upward from the circuit board 4. A screw penetrating through the outer rims of the volume restrictor 3 and the circuit board 4 are screwed to a flat support portion of the main body 11 to firmly fix the rim of the volume restrictor 3 to the upper surface of the circuit board 4. A sealant may be provided between the outer rim of the volume restrictor 3 and the circuit board 4 to fill the gap therebetween and thus to enhance the airtightness of the internal space of the volume restrictor 3.

In this way, the circuit board 4 and the volume restrictor 3 define a hemispherical enclosed space. The volume restrictor 3 partitions the space 12 such that the enclosed space largely occupies the space 12 and decreases the volume of the space 12. The volume restrictor 3 is sized such that the openings 13 of the main body 11 are not entirely covered. The volume restrictor 3 surrounds the surface of the circuit board 4 on which electronic components are mounted.

The volume restrictor 3 has a cylindrical guide 31 in its center. The guide 31 is integrated with the volume restrictor 3 along the center axis of the volume restrictor 3. The guide 31 supports a rigid rod conductor 15. The rigid conductor 15 slides in the guide 31 along the center axis of the volume restrictor 3 in the longitudinal direction of the rigid conductor 15. The rigid conductor 15 is a column with hemispherical ends in the longitudinal direction.

The rigid conductor 15 electrically connects the fixed electrode 20, which is a signal output terminal of the condenser microphone unit 2, with a predetermined electrode pattern of the circuit board 4. An elastic conductor 16, for example, composed of a conductive fabric is compressed between the rigid conductor 15 and the predetermined electrode pattern of the circuit board 4. Thus, the rigid conductor 15 is urged toward the fixed electrode 20 by the resilient force of the elastic conductor 16 to establish an electrical connection between the fixed electrode 20 and the predetermined electrode pattern of the circuit board 4. The elastic conductor 16 may be disposed between the rigid conductor 15 and the signal output terminal of the condenser microphone unit 2 or elastic conductors 16 may be disposed at both ends of the rigid conductor 15. The center region of the fixed electrode 20 in contact with the upper end of the rigid conductor 15 has a depression 22 to receive the rigid conductor 15.

The volume restrictor 3 is composed of an electrically and acoustically insulating material. In this embodiment, the volume restrictor 3 is composed of a resin, more specifically a polycarbonate (PC) resin. Any other material equivalent to this may also be used. In order to slidably support the rigid conductor 15, a minute gap is formed between the outer circumferential surface of the rigid conductor 15 and the inner circumferential surface of the guide 31. Acoustic waves entering the internal space of the volume restrictor 3 through this gap vibrates the components of the circuit board 4. To prevent this, the gap is sealed with a sealing member. Alternatively, a sealant or a lubricant, such as grease, may be used.

The electronic components mounted on the circuit board 4 constitute an electronic circuit that outputs signals from the condenser microphone unit 2 in the form of microphone output signals. The electronic circuit includes a field-effect transistor (FET) to convert the output impedance of the condenser microphone unit 2. The electronic circuit may also include a buffer amplifier and/or a signal processing circuit for balanced output, if required. The diaphragm 18 is a second electrode that outputs signals from the condenser microphone unit 2. The diaphragm 18 is electrically connected to the predetermined circuit pattern on the circuit board 4 via the unit case 1.

In addition to reducing the volume of the space 12, the volume restrictor 3 serves as a shield to prevent sound waves that enter the openings 13 and travel through the space 12 from reaching the electronic components of the circuit board 4. The volume restrictor 3 also serves as a damper of the circuit board 4.

The lower half of the main body 11 of the unit case 1 is in the form of a cylinder 32. An intermediate cylinder 42 is disposed around the outer circumference of the cylinder 32 at a predetermined gap. The top and bottom of the cylinder 32 are connected to the intermediate cylinder 42 via dampers 41 and 43, respectively. A cylindrical intervening member 44 integrated with a portion of the microphone case is disposed around the outer circumference of the intermediate cylinder 42 at a predetermined gap. The intermediate cylinder 42 and the intervening member 44 are connected with the dampers 41 and 43 disposed therebetween. The intervening member 44 is connectable to a cylindrical grip (not shown) that constitutes another portion of the microphone case. The dampers 41 and 43 buffer the microphone case, which is installed in the microphone case.

A front mesh 45 is attached to the intervening member 44. The front mesh 45 covers the condenser microphone unit 2 and the unit case 1 at a predetermined gap. In the embodiment illustrated in the drawings, the front mesh 45 is mounted to the intervening member 44 by engaging external threads on the outer circumference of the intervening member 44 with internal threads in the inner circumference of the front mesh 45. The front mesh 45 transmits external sound waves.

In the condenser microphone according to the embodiment described above, the volume restrictor 3 occupies a large volume of the internal space 12 of the unit case 1, which is in communication with the rear acoustic terminal 21 of the condenser microphone unit 2. The resulting space 12 is small and barely resonates. Even if the space 12 happens to resonate, the generated resonant frequency will be high. Thus, an excellent frequency response is achieved in the frequency range of typical audio waves.

The volume restrictor 3 also serves as a shield to block sound waves that enter the openings 13 of the unit case 1 and travel through the space 12 toward the circuit board 4. Even if sound waves with high acoustic pressure enter the space 12, the volume restrictor 3 shields the sound waves toward the electronic components mounted on the circuit board 4. Thus, the vibration of the electronic components caused by the sound waves with high acoustic pressure is prevented, and noise due to the vibration of the electronic components is not generated. As a result, the condenser microphone has high sound quality.

The slidable conductor 15 supported by the volume restrictor 3 electrically connects the signal output terminal of the condenser microphone unit 2 with the circuit board 4. Such an electrical connection of the circuit board 4 does not require a special structure. This increases the design flexibility of the circuit board 4 on which the electronic components are mounted. The elastic conductor 16 is compressed between the rigid conductor 15 and the circuit board 4 or between the rigid conductor 15 and the signal output terminal of the condenser microphone unit 2. This establishes electrical connection between the condenser microphone unit 2 and the circuit board 4.

The elastic conductor 16 disposed between the rigid conductor 15 and the circuit board 4 or the signal output terminal of the condenser microphone unit 2 establishes the electrical connection of the signal output terminal with the circuit board 4 regardless of a variation in size of the rigid conductor 15. The elastic conductor 16 compressed between the rigid conductor 15 and the circuit board 4 or the signal output terminal of the condenser microphone unit 2 prevents the vibration of the circuit board 4 and other components.

In this embodiment, the main body 11 and the head case 23 of the unit case 1 are joined by the engagement of the external and internal threads. The front mesh 45 and the intervening member 44 are also joined by the engagement of the external and internal threads. The head case 23 can be readily removed from and reinstalled to the unit case 1 with the intervening member 44 removed from the front mesh 45. Thus, the condenser microphone unit 2 can be readily replaced. The replacement of the condenser microphone unit 2 does not interrupt the connection between the condenser microphone unit 2 and the circuit board 4, and an electrical connection between the condenser microphone unit 2 and the circuit board 4 is established simply by the attachment of the condenser microphone unit 2 to the unit case 1.

The condenser microphone according to the present invention generates high-quality audio signals from sound waves with high acoustic pressure. Thus, the condenser microphone is particularly suitable for the use near a musical instrument that generates large sounds. The condenser microphone may also be used under various conditions, other than large sounds and can produce signals with high sound quality even if waves of large sounds happen to enter the condenser microphone.

What is claimed is:

1. A condenser microphone comprising:

a condenser microphone unit having a rear acoustic terminal;

a unit case that supports the condenser microphone unit, has an internal space in communication with the rear acoustic terminal, and has an opening in a peripheral wall in communication with the internal space;

a volume restrictor that is disposed in the internal space and reduces the volume of the internal space by partitioning the internal space;

a circuit board that is disposed in the internal space partitioned by the volume restrictor and surrounded by the volume restrictor; and a rigid conductor that electrically connects a signal output terminal of the condenser microphone unit and the circuit board, wherein, the circuit board is disposed such that a surface of the circuit board intersects a center axis of the unit case, the rigid conductor is supported in such a manner that the rigid conductor slides along the volume restrictor, and an elastic conductor is compressed between the rigid conductor and the circuit board or between the rigid conductor and the signal output terminal.

2. The condenser microphone according to claim 1, wherein a processing circuit that outputs an output signal from the condenser microphone unit in a form of a microphone output signal is installed on the circuit board.

3. The condenser microphone according to claim 1, wherein the signal output terminal comprises a fixed electrode facing a diaphragm of the condenser microphone unit.

4. The condenser microphone according to claim 1, wherein the volume restrictor is hemispherical and covers a surface of the circuit board on which circuit components are mounted.

5. The condenser microphone according to claim 1, wherein the volume restrictor comprises a cylindrical guide that slidably supports the rigid conductor.

6. The condenser microphone according to claim 5, wherein a sealing member is disposed between the outer circumference of the rigid conductor and the inner circumferential surface of the cylindrical guide.

7. The condenser microphone according to claim 1, further comprising a sealant disposed between the volume restrictor and a surface of the circuit board facing the volume restrictor to fill the gap between the volume restrictor and the circuit board.

8. The condenser microphone according to claim 1, wherein the volume restrictor serves as a damper that prevents vibration of the circuit board on which electronic components are mounted caused by sound waves.

9. The condenser microphone according to claim 1, wherein the condenser microphone unit has unidirectionality.

10. The condenser microphone according to claim 1, wherein the volume restrictor comprises a polycarbonate material.

11. The condenser microphone according to claim 1, further comprising a fixed electrode in contact with an upper end of the rigid conductor.

12. The condenser microphone according to claim 11, wherein the fixed electrode has depression to receive the upper end of the rigid conductor.

* * * * *